United States Patent [19]

Bowland

[11] Patent Number: 4,856,652

[45] Date of Patent: Aug. 15, 1989

[54] SELF-CONTAINED OIL SOURCE AND DRAIN PACKAGE

[75] Inventor: Robert O. Bowland, Grosse Pointe, Mich.

[73] Assignee: Chrysler Motors Corporation, Highland Park, Mich.

[21] Appl. No.: 178,038

[22] Filed: Apr. 4, 1988

[51] Int. Cl.[4] ..... B65D 69/00

[52] U.S. Cl. ..... 206/223; 206/141; 206/427; 220/1 C; 220/1 S; 184/1.5; 184/106; 294/144

[58] Field of Search ..... 206/141, 223, 303, 427, 206/429, 525, 527, 634; 220/1 C, 1 S, 85 H; 184/1.5, 106; 294/141, 144, 172

[56] References Cited

U.S. PATENT DOCUMENTS

| | | | |
|---|---|---|---|
| 2,301,927 | 11/1942 | Brogden | 294/144 |
| 3,428,235 | 9/1967 | Randazzo . | |
| 3,703,956 | 11/1972 | Oswalt . | |
| 3,842,976 | 10/1974 | Dea | 206/223 |
| 3,954,250 | 5/1976 | Grace . | |
| 4,098,398 | 7/1978 | Meyers . | |
| 4,133,428 | 1/1979 | Glöyer | 206/427 |
| 4,403,692 | 9/1983 | Pollaco . | |
| 4,442,936 | 4/1984 | Densham | 206/223 |
| 4,477,014 | 10/1984 | Brandenburger | 206/634 |
| 4,524,866 | 6/1985 | Pollacco . | |
| 4,533,042 | 8/1985 | Pollacco | 206/223 |
| 4,566,593 | 1/1986 | Muller | 206/634 |
| 4,640,431 | 2/1987 | Harrison | 206/223 |
| 4,756,411 | 7/1968 | Garland | 206/223 |
| 4,765,476 | 8/1988 | Lee | 206/427 |

*Primary Examiner*—David T. Fidei

*Attorney, Agent, or Firm*—Mark P. Calcaterra

[57] ABSTRACT

Components of the package are a leakproof container of sufficient size and shape to hold five quarts of motor oil and one engine oil filter and a zip-type, tear-open top to the container with a pull tab.

The container is made of a paper-based material which allows interior coating to provide a leak resistant environment once engine oil is drained from an engine into the open container. The size and shape of the container is unique to the size and configuration of the five quarts of motor oil and the single engine oil filter contained within the carton. Before opening, the container top is a means to contain the five quarts of motor oil and engine oil filter. The zip-type, tear-open top with pull tab is a means to open the container, revealing and providing access to the five quarts of motor oil and engine oil filter contained within. This access also allows a fully opened carton of suitable size and shape to be placed under an automobile so as to provide a receptacle for the drainage of the used oil from its engine.

6 Claims, 1 Drawing Sheet

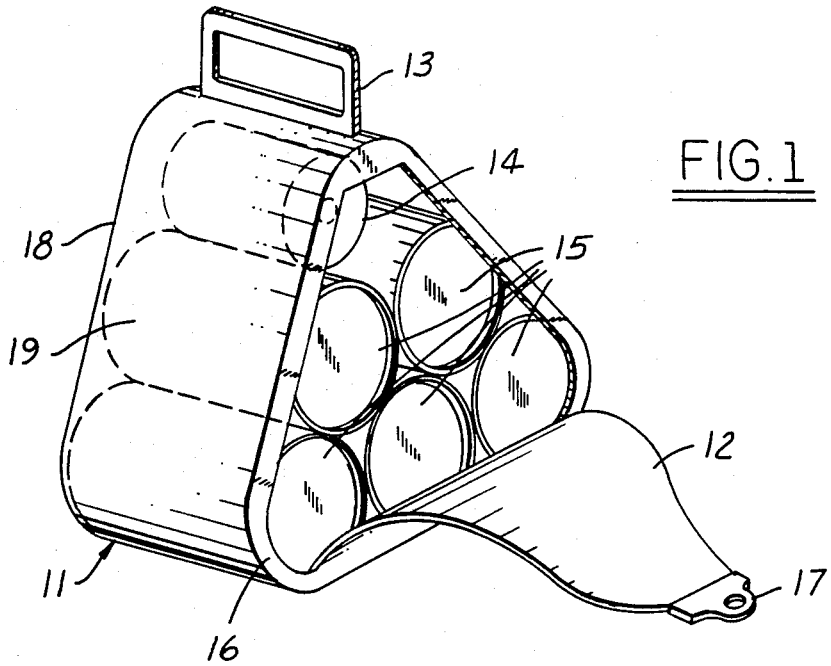
FIG. 1
FIG. 2
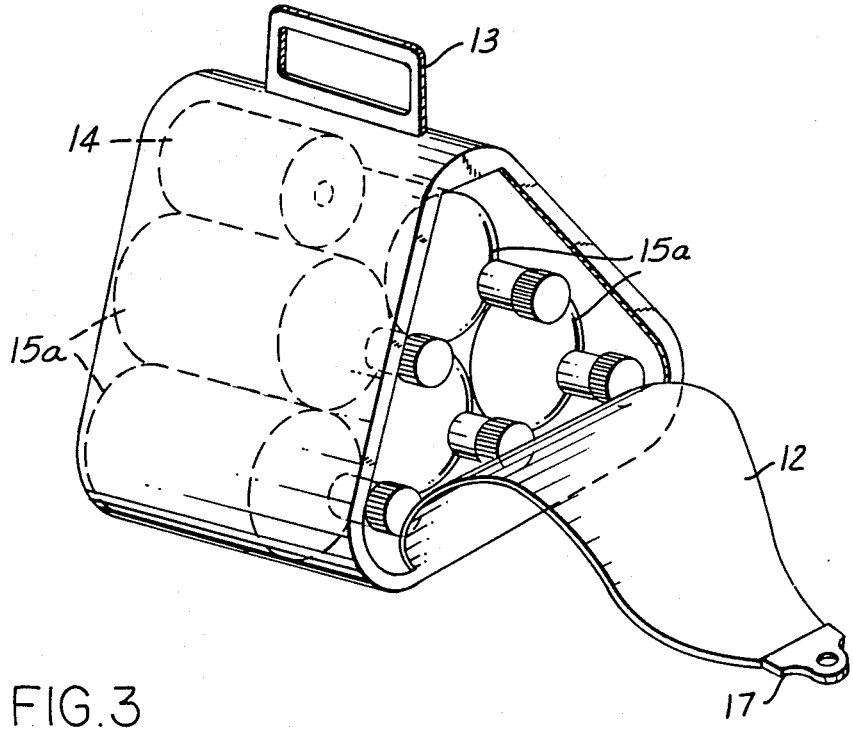
FIG. 3
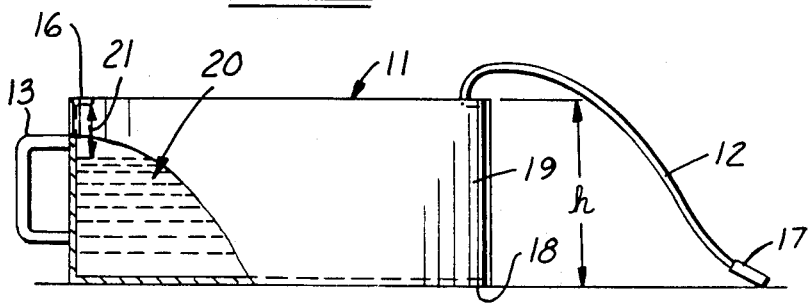

SELF-CONTAINED OIL SOURCE AND DRAIN PACKAGE

BACKGROUND AND SUMMARY OF THE INVENTION

This invention relates to the packaging of motor oil and an automotive engine oil filter together in a package which also serves as an engine oil drain pan.

Components of the package are a leakproof container of sufficient size and shape to hold five quarts of motor oil and one engine oil filter and a zip-type, tear-open top to the container, with a pull tab.

The container is made of a paper-based material which allows interior coating to provide a leak-resistant environment once engine oil is drained from an engine into the open container. The size and shape of the container is unique to the size and configuration of the five quarts of motor oil and the single engine oil filter contained within the carton. Before opening, the container top is a means to contain the five quarts of motor oil and engine oil filter. The zip-type, tear-open top with pull tab is a means to open the container, revealing and providing access to the five quarts of motor oil and engine oil filter contained within. This access also allows a fully opened carton of suitable size and shape to be placed under an automobile so as to provide a receptacle for the drainage of the used oil from its engine.

Some of the previous motor oil changing kits are shown in the following patents.

U.S. Pat. No. 4,524,866 issued on June 25, 1985 to Pollacco discloses a motor oil change kit with a catch pan. A resealable jug is provided. No oil filter is illustrated in the kit.

U.S. Pat. No. 4,403,692 issued Sept. 3, 1983 to Pollacco discloses another resealable type motor oil change kit again with no contemplation of oil filters.

U.S. Pat. No. 4,098,398 issued on July 4, 1978 to Meyers discloses a container to transport cans of motor oil which doubles as a drain container and is designed to dispose of the oil. Also disclosed is supporting member 67 which appears to be designed to provide support to the corner opening 64. In addition, a support member 67 is also designed to engage the lip 71 on the funnel 70.

U.S Pat. No. 3,954,250 issued on May 4, 1976 to Grace discloses a mechanical drain valve.

U.S. Pat. No. 3,703,956 issued on Nov. 28, 1972 to Oswalt discloses an oil change kit with several components including cans of oil, drain adaptors for remote draining of the oil, a funnel, and a wrapper. No oil filter is disclosed.

U.S. Pat. No. 3,428,235 issued on Feb. 18, 1969 to Randazzo discloses a generally triangular shaped carton carrier.

DESCRIPTION OF THE DRAWING

Other objects, features and advantages of this invention will become more fully apparent from the following Detailed Description of the Preferred Embodiment and in the accompanying drawing in which;

FIG. 1 is a perspective view of the container described herein;

FIG. 2 is another perspective of the same container described herein shown carrying plastic oil filled bottles instead of the oil cans as illustrated in FIG. 1.; and FIG. 3 shows the subject invention seated on base 18 after accepting used oil as drained from a vehicle's engine.

DETAILED DESCRIPTION OF THE PREFERRED EMBODIMENT

Referring to FIG. 1, the container 11 or of the Self-Contained Oil Source and Drain Package, is illustrated along with its contents when first opened. The single engine oil filter 14 is supported by the five cans of motor oil 15 when the container 11 is in its upright position. The tear-away top 12 is shown in its open position allowing access to the contents of the container 11. The carrying/positioning handle 13 is provided as a convenience.

When the open container 11 is placed in a position with the tear-away top 12 in the uppermost and fully opened position, the empty container 11 may be placed under an automobile in such a position as to receive used engine oil as it is being drained from the engine. A leak-resistant coating (not shown) on the interior surface of the container 11 prevents the used engine oil from penetrating the container 11.

In order to facilitate opening of the tear-away top 12 of container 11, perforations or other such aids (not shown) outline a lip portion 16 which is defined when the top 12 is opened; pull tab 17 is also provided at an apex of the triangular shaped tear-away top 12 to further facilitate opening.

The lip 16 is provided for carrying the perforation at the junction between the container 11 and tear-away top 12. Another purpose of the lip 16 is to provide a retention means for retaining drained or used oil in container 11 when the container 11 is seated on base 18 after the used oil has been drained from the vehicle's engine. The container 11, now carrying the drained used oil and seated upon base 18 can then be removed from underneath the vehicle with the aid of the carrying/positioning handle 13 and then transported to an appropriate oil reclamation site with little risk of oil spillage. After proper deposit of the used oil at an appropriate oil reclamation site, the container 11 is then ready for proper disposal.

The entire container 11, in its preferred embodiment is shown in the Figures as a triangular shaped top 12 and base 18 spanned by a panel 19. The two triangular shapes, top 12 and base 18 are generally spanned by an outer panel 19 which wraps around each apex (rounded corners) of the generally triangular shapes, tear-away top 12 and base 18. In its preferred embodiment many or all of the above recited elements of container 11 can be integrally formed with the appropriate foil, cardboard, paper, and/or plastic container technology utilizing features such as scoring, folding, perforations, and molding.

Disposed along the outer panel 19 and along the apex (one of the rounded corners) of the generally triangular shapes, tear-away top 12 and base 18, is a carrying/positioning handle 13. The purpose of this handle is not only to carry the entire container 11 retaining motor oil canisters (cans) 15 and the oil filter 14 but also to allow for easy positioning of the entire container 11 once opened underneath the vehicle's engine for draining of the oil therein.

An advantage of the generally triangular shaped top 12 and base 18 spanned by outer panel 19 of container 11, is that the generally cylindrical cans of motor oil 15 and oil filter 14 can easily be stored therein with little or no wasted space. In addition, the oil filter 14 can be further customized to fit inside the container 11 by means of space occupying fillers (not shown) such as corrugated cardboard, the size of which will be a function of the size of the oil filter 14.

Still another advantage of the generally triangular top 12 and base 18 spanned by outer panel 19 of container 11, is that it provides inherent rigidity and strength once filled with used oil. If such a container were formed with generally a rectangular shaped top and base, the outer panel would tend to buckle when filled with used oil if not manufactured with expensive rigid materials. The preferred embodiment shown in FIGS. 1 and 2 anticipates that the material forming the outer panel 19, lip 16 and the base 18 will be coated cardboard material such that the coating will resist leaks. The material used for the tear-away top 12 will generally be metallic foil.

Shown in FIG. 2 is the same invention as in FIG. 1 only modified for carrying plastic bottles 15*a* of motor oil instead of cans as shown in FIG. 1.

FIG. 3 shows the subject invention seated on base 18 after accepting used oil as drained from a vehicle's engine.

Referring again to FIGS. 2 and 3, it can be seen that the approximate volume of the container 11 filled with used oil 20 will rise only to approximately two-thirds of the volume capacity of the container 11. The reason for this is, in the case of packaging for plastic bottles 15*a*, the neck of the oil bottle 15*a* is approximately one-third the vertical distance between the top of the bottle and bottom of the bottle. In addition, the volume occupied the oil filter 14 and any packing material (not shown) above the filter 14 and/or the bottles 15*a* will be vacant once the oil filter has been installed and the packing material, if any, is removed. The combined free space 21 in the container 11 is therefore approximately one-third the volume of the container. This in combination with the lip 16 allows for the reasonable retention of the used oil for transportation of used oil to an oil reclamation site so long as the base 18 is flatly seated during transport.

Similar free space 21 will be provided for used oil in the embodiment shown in FIG. 1. The volume of container 11 available for storing used oil 20 can be controlled by the size of the oil filter 14 and, the height "h" of the outer panel 19 and the amount of filler material (not shown), if any, around the filter 14 and/or above the filter 14 and/or the oil cans 15.

The used oil 20 can be poured out of the container 11 by using one apex of the top 12 as a spout.

While the present invention has been disclosed in connection with the preferred embodiment thereof, it should be understood that there may be other embodiments which fall within the spirit and scope of the invention and that the invention is susceptible modification, variation, and change without departing from the proper scope or fair meaning of the following claims.

I claim:

1. A self-contained oil source and drain package for use in changing the engine oil of an automobile, the package comprising:

a container to house and carry oil canisters and an oil filter;

said container defining one space for the oil canisters and oil filter, said container being sized such that the portion of the space occupied by used oil drained form the engine into said container is less than the total space defined by said container;

said container further comprising:

a generally triangular shaped top and base where said top is at least partially tear-away removable, by aids such as perforations, from said container; and an outer panel spanning the top and base such that the oil canisters and oil filter are stacked and carried in the space so spanned so as to form a triangle as viewed from the top or the base.

2. The self-contained oil source and drain package of claim 1, where said container is sized such that the portion of the space occupied by the oil canisters and oil filter is approximately two-thirds of the space defined by the container, thereby allowing the remainder as free space for the reasonable retention of oil drained from the engine.

3. The self-contained oil source and drain package of claim 1 where the generally triangular shaped top is at least partially tear-away removable from the container from an apex of the triangular shaped tear-away top.

4. The self-contained oil source and drain package of claim 1 where the container further comprises:

retention means to prevent excess spillage of used oil that has been temporarily drained into the container.

5. The self-contained oil source and drain package of claim 4 where the retention means comprises a lip formed when the tear-away removable top is at least partially removed from the container.

6. The self-contained oil source and drain package of claim 1 where the generally triangular shaped top is at least partially tear-away removable from the container by means of a pull tab at an apex of the triangular shaped tear-away top.

* * * * *